US011853091B2

(12) United States Patent
Lee

(10) Patent No.: US 11,853,091 B2
(45) Date of Patent: Dec. 26, 2023

(54) VOLTAGE REGULATING DEVICE AND MODE SWITCHING DETECTING CIRCUIT

(71) Applicant: ALi Corporation, Hsinchu (TW)

(72) Inventor: Andrew Yang Lee, Taipei (TW)

(73) Assignee: ALi Corporation, Hsinchu (TW)

( * ) Notice: Subject to any disclaimer, the term of this patent is extended or adjusted under 35 U.S.C. 154(b) by 86 days.

(21) Appl. No.: 17/519,503

(22) Filed: Nov. 4, 2021

(65) Prior Publication Data

US 2022/0147086 A1 May 12, 2022

(30) Foreign Application Priority Data

Nov. 9, 2020 (CN) ..... 202011237180.7

(51) Int. Cl.
*G05F 1/575* (2006.01)

(52) U.S. Cl.
CPC ..... *G05F 1/575* (2013.01)

(58) Field of Classification Search
CPC ..... G05F 1/462; G05F 1/465; G05F 1/468; G05F 1/56; G05F 1/575; G05F 1/562; G05F 1/565; G05F 1/567; G05F 1/569; G05F 1/571; G05F 1/573; G05F 1/5735
See application file for complete search history.

(56) References Cited

U.S. PATENT DOCUMENTS 6,452,368 B1 * 9/2002 Basso ..... H02M 3/156 323/275
6,828,834 B2 * 12/2004 Sivero ..... G05F 1/465 327/143
7,573,252 B1 * 8/2009 Griesert ..... G05F 3/262 323/901
8,018,214 B2 * 9/2011 Kwon ..... G05F 1/565 323/901
9,454,164 B2 * 9/2016 Bhattad ..... G05F 1/573
9,459,641 B2 * 10/2016 Sakaguchi ..... G05F 1/5735
10,180,695 B1 * 1/2019 Bikulcius ..... G05F 1/468
10,345,838 B1 * 7/2019 Karadi ..... G05F 1/575
11,099,591 B1 * 8/2021 Köse ..... G05F 1/59
2005/0077884 A1 * 4/2005 Krug ..... H02M 3/156 323/282
2009/0085345 A1 * 4/2009 Kobayashi ..... B42D 15/006 283/101

(Continued)

*Primary Examiner* — Kevin J Comber
*Assistant Examiner* — Nusrat Quddus
(74) *Attorney, Agent, or Firm* — JCIPRNET

(57) ABSTRACT

A voltage regulating device and a mode switching detecting circuit are provided. The mode switching detecting circuit is configured to reset a soft start circuit of the voltage regulating device. The mode switching detecting circuit includes a mode switching signal detector, a reset signal generator, and a reset status detector. The mode switching signal detector receives a mode switching signal and generates a setting signal according to a transition edge of the mode switching signal. The reset signal generator is coupled to the mode switching signal detector and generates a reset activating signal according to the setting signal. The reset activating signal drives the soft start circuit to perform a reset operation. The reset status detector compares an output voltage of the soft start circuit and a reference voltage to generate a clear signal. The reset signal generator clears the reset activating signal according to the clear signal.

9 Claims, 2 Drawing Sheets

(56) References Cited

U.S. PATENT DOCUMENTS

2009/0115379 A1* 5/2009 Al-Shyoukh ..... G05F 1/56 323/238
2009/0309559 A1* 12/2009 Xia ..... G05F 1/56 323/265
2010/0131219 A1* 5/2010 Kenly ..... G01R 19/0092 702/64
2013/0200873 A1* 8/2013 Wu ..... H02M 1/36 323/288
2013/0241516 A1* 9/2013 Ueno ..... G05F 1/618 323/285
2013/0285630 A1* 10/2013 Wang ..... G05F 1/562 323/275
2014/0103890 A1* 4/2014 Naidu ..... G05F 1/10 323/269
2014/0217999 A1* 8/2014 Wibben ..... G05F 1/468 323/282
2014/0253072 A1* 9/2014 Hussien ..... H02M 1/36 323/288
2015/0035505 A1* 2/2015 Peluso ..... G05F 1/465 323/273
2015/0042299 A1* 2/2015 Li ..... H02M 3/1588 323/271
2015/0334795 A1* 11/2015 Strijker ..... H01L 27/0262 315/291
2017/0017249 A1* 1/2017 Jezik ..... G05F 1/468
2018/0267480 A1* 9/2018 Mahajan ..... G04F 10/005
2019/0115841 A1* 4/2019 Maruyama ..... H02M 3/33523
2020/0274445 A1* 8/2020 Mei ..... H03K 5/24
2020/0393862 A1* 12/2020 Yu ..... G06F 1/26
2021/0006158 A1* 1/2021 Neyra ..... H02M 1/32
2021/0124382 A1* 4/2021 Deka ..... G05F 1/461
2021/0313882 A1* 10/2021 Neyra ..... H02M 3/156
2022/0060109 A1* 2/2022 Wollschlager ..... H02M 1/36
2022/0209674 A1* 6/2022 Wang ..... H02M 3/33571

* cited by examiner

VOLTAGE REGULATING DEVICE AND MODE SWITCHING DETECTING CIRCUIT

CROSS-REFERENCE TO RELATED APPLICATION

This application claims the priority benefit of Chinese application no. 202011237180.7, filed on Nov. 9, 2020. The entirety of the above-mentioned patent application is hereby incorporated by reference herein and made a part of this specification.

BACKGROUND

Technical Field

The disclosure relates to a voltage regulating device and a mode switching detecting circuit thereof; particularly, the disclosure relates to a voltage regulating device and a mode switching detecting circuit thereof that reduce a surge current during voltage mode switching.

Description of Related Art

Low dropout voltage conversion devices have been widely applied in electronic products. In the current technologies, in addition to providing an adjustable output voltage lower than the operation power, the low dropout voltage conversion device also requires to have a voltage switching capability. In the known technical field, a low dropout voltage conversion device is commonly seen to switch the output voltage between 1.8 volts and 3.3 volts. In actual working, when the output voltage is switched from 1.8 volts to 3.3 volts (or from 3.3 volts to 1.8 volts) in an instant, a surge current with a large amplitude will be generated. Such surge current may cause electromagnetic interference and affect the normal operation of the electronic device. Alternatively, when the amplitude of surge current is too large, damage may also be caused to circuit components in the electronic device.

SUMMARY

The disclosure relates to a voltage regulating device and a mode switching detecting circuit thereof, which reduce a surge current generated in a voltage switching mode.

According to an embodiment of the disclosure, the mode switching detecting circuit is configured to reset a soft start circuit of a voltage regulating device. The mode switching detecting circuit includes a mode switching signal detector, a reset signal generator, and a reset status detector. The mode switching signal detector receives a mode switching signal, and generates a setting signal according to a transition edge of the mode switching signal. The reset signal generator is coupled to the mode switching signal detector, and generates a reset activating signal according to the setting signal. The reset activating signal drives the soft start circuit to perform a reset operation. The reset status detector compares an output voltage of the soft start circuit and a reference voltage to generate a clear signal. The reset signal generator clears the reset activating signal according to the clear signal.

According to an embodiment of the disclosure, the voltage regulating device includes a soft start circuit, an amplifier, and the mode switching detecting circuit as stated above. The amplifier has a negative input end receiving a feedback signal. The amplifier has a positive input end to be coupled to the output end of the soft start circuit. The amplifier generates a driving voltage. The power transistor receives an operation power and, based on the operation power, generates a regulated output voltage according to the driving voltage. The mode switching detecting circuit is coupled to the output end of the soft start circuit.

Based on the foregoing, the voltage regulator of the disclosure resets and reactivates the soft start circuit when a voltage mode switching operation is performed, which effectively reduces a surge current generated due to a change in output voltage.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
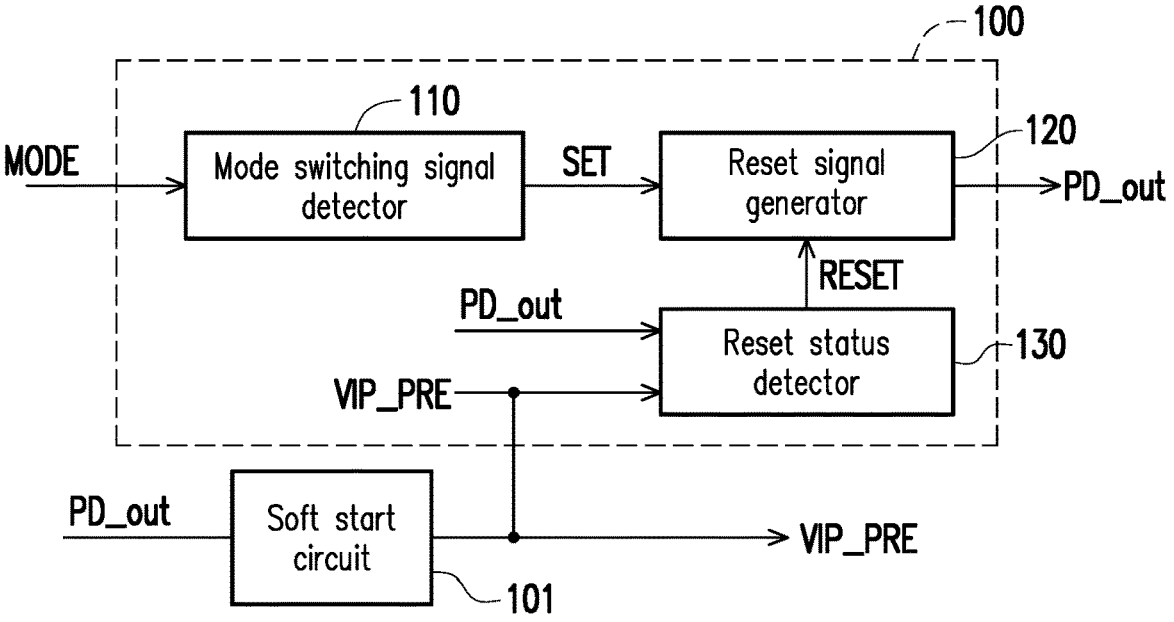
FIG. 1 is a schematic diagram showing a mode switching detecting circuit according to an embodiment of the disclosure.

Reference will now be made in detail to exemplary embodiments provided in the disclosure, examples of which are illustrated in the accompanying drawings. Wherever possible, the same reference numerals are used in the drawings and descriptions to refer to the same or similar parts.

With reference to FIG. 1, which is a schematic diagram showing a mode switching detecting circuit according to an embodiment of the disclosure, the mode switching detecting circuit is applied to a voltage regulating device, and when the voltage regulating device executes a voltage switching mode, resets the soft start circuit in the voltage regulating device to reduce a surge current generated due to the change in the output voltage of the voltage regulating device. A mode switching detecting circuit 100 includes a mode switching signal detector 110, a reset signal generator 120, and a reset status detector 130. The mode switching signal detector 110 receives a mode switching signal MODE. The mode switching signal detector 110 generates a setting signal SET according to a transition edge of the mode switching signal MODE. Herein, when the voltage regulating device executes the voltage switching mode, the mode switching signal MODE may be switched from a first logical value to a second logical value, or from the second logical value to the first logical value, where the first logical value and the second logical value are complementary. The mode switching signal detector 110 is configured to detect whether the mode switching signal MODE has changed in logical value, and generate the setting signal SET according to the transition edge where the mode switching signal MODE has changed in logical value.

The reset signal generator 120 is coupled to the mode switching signal detector 110. The reset signal generator 120 receives the setting signal SET, and generates a reset activating signal PD_out according to the setting signal SET. Herein, the reset activating signal PD_out is configured to reset a soft start circuit 101 and reactivate the soft start circuit 101.

In this embodiment, the reset activating signal PD_out may be transmitted to the reset status detector 130. The reset status detector 130 is coupled to the soft start circuit 101 and is configured to compare an output voltage VIP_PRE generated by the soft start circuit 101 with a default reference voltage VBG. In addition, the reset status detector 130 also generates a clear signal RESET through a comparison result between the output voltage VIP_PRE of the soft start circuit 101 and the default reference voltage VBG. Herein, the clear signal RESET is transmitted to the reset status detector 130 and is configured to clear the setting signal SET generated by the reset status detector 130.

Besides, in this embodiment, a discharge path may be provided in the reset status detector 130, and a discharge operation is performed on the output voltage VIP_PRE of the soft start circuit 101 according to the reset activating signal PD_out to pull down the output voltage VIP_PRE of the soft start circuit 101. Through pulling down the output voltage VIP_PRE of the soft start circuit 101, the soft start circuit 101 may be reset and reactivated. In this way, in the voltage switching mode of the voltage regulating device, the surge current generated by the voltage regulating device may be reduced through reactivating the soft start circuit 101.

In this embodiment, the soft start circuit 101 may perform a soft start operation through gradually pulling up the output voltage VIP_PRE that is generated. In the low dropout (LDO) voltage regulating device, the output voltage VIP_PRE may be provided to a positive input end of an amplifier therein. Besides, the soft start rate of the voltage regulating device may be controlled through regulating the pull-up rate of the output voltage VIP_PRE.

In an embodiment of the disclosure, at the start of the soft start operation performed by the soft start circuit 101, the output voltage VIP_PRE of the soft start circuit 101 may be 0 volt. During the soft start process, the soft start circuit 101 may gradually increase the output voltage VIP_PRE, and when the output voltage VIP_PRE is increased to be equal to an operation power, the soft start operation is ended. Besides, in this embodiment, a discharge path may be provided in the reset status detector 130 so that when a transition of the mode switching signal MODE occurs, the output voltage VIP_PRE of the soft start circuit 101 is correspondingly pulled down. In this way, the soft start operation performed by the soft start circuit 101 can be performed again, and the surge current that may be generated during output voltage switching by the voltage regulating device is reduced.

Figure 2:
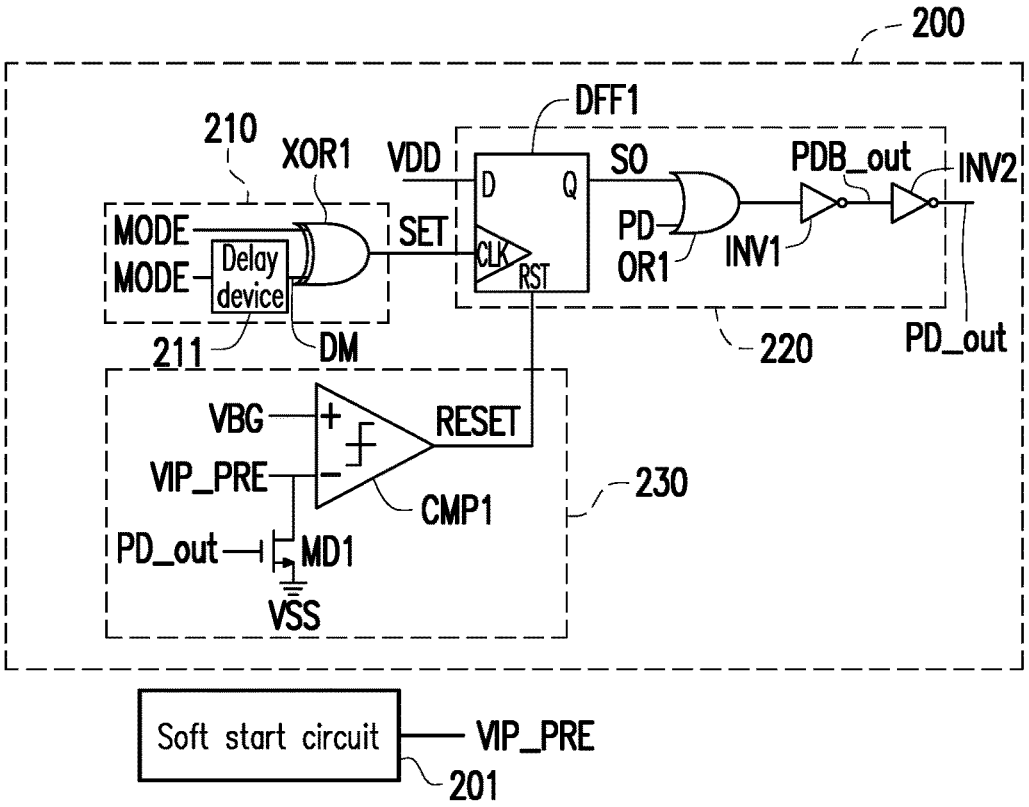
FIG. 2 is a schematic diagram showing a mode switching detecting circuit according to another embodiment of the disclosure.

In the following, with reference to FIG. 2, which is a schematic diagram showing a mode switching detecting circuit according to another embodiment of the disclosure, a mode switching detecting circuit 200 is coupled to a soft start circuit 201. The mode switching detecting circuit 200 includes a mode switching signal detector 210, a reset signal generator 220, and a reset status detector 230. The mode switching signal detector 210 is configured to delay the mode switching signal MODE that is received, to generate a delay mode switching signal DM. In addition, the mode switching signal detector 210 also compares the delay mode switching signal DM and the mode switching signal MODE and determines a phase difference therebetween to generate the setting signal SET.

Specifically, the mode switching signal detector 210 includes a delay device 211 and an XOR gate XOR1. The delay device 211 receives the mode switching signal MODE, and generates the delay mode switching signal DM through delaying the mode switching signal MODE. Two input ends of the XOR gate XOR1 respectively receive the mode switching signal MODE and the delay mode switching signal DM. The XOR gate XOR1 determines the phase difference between the mode switching signal MODE and the delay mode switching signal DM, and generates the setting signal SET with a pulse according to the phase difference between the mode switching signal MODE and the delay mode switching signal DM. Herein, the pulse of the setting signal SET corresponds to the position of the transition edge of the mode switching signal MODE. Moreover, the duration of the delay provided by the delay device 211 is substantially the same as the width of the pulse of the setting signal SET.

On the other hand, the reset signal generator 220 includes a D-type flip-flop DFF1, an OR gate OR1, and inverters INV1 and INV2. The D-type flip-flop DFF1 has a clock end CLK, a data end D, an output end Q, and a reset end RST. The data end D of the D-type flip-flop DFF1 receives an operation power VDD. The clock end CLK of the D-type flip-flop DFF1 receives the setting signal SET. The reset end of the D-type flip-flop DFF1 is coupled to the reset status detector 230. The output end Q of the D-type flip-flop DFF1 generates a signal SO, and the reset activating signal PD_out may be generated according to the signal SO.

When the mode switching signal detector 210 detects that a transition of the mode switching signal MODE occurs, the mode switching signal detector 210 generates the setting signal SET with the pulse. According to the pulse of the setting signal SET, the D-type flip-flop DFF1 sets the signal SO at the output end to a logical value of 1 according to the operation power VDD. Accordingly, the reset signal generator 220 generates the reset activating signal PD_out having a logical value of 1.

On the other hand, the OR gate OR1 receives signals SO and PD. In this embodiment, the signal PD is configured to control the soft start circuit 201 to perform the soft start operation when the operation power of the voltage regulating device is reactivated. In this embodiment, when any one of the signals SO and PD has a logical value of 1, the reset activating signal PD_out having a logical value of 1 may thus be generated.

According to the output of the OR gate OR1, the inverters INV1 and INV2 respectively generate a reverse reset activating signal PDB_out and the reset activating signal PD_out in sequence. Herein, the inverters INV1 and INV2 serve as buffers. Through the inverter INV2, the fan-out capability of the reset activating signal PD_out may be increased.

Incidentally, when the signal SO at the output end Q of the D-type flip-flop DFF1 is set to a logical value of 1, the signal SO can only be cleared by the clear signal RESET at the reset end RST of the D-type flip-flop DFF1. In this embodiment, when the clear signal RESET has a logical value of 1, the signal SO at the output end Q of the D-type flip-flop DFF1 is cleared to a logical value of 0.

The reset status detector 230 includes a comparator CMP1 and a discharge switch composed of a transistor MD1. In this embodiment, a positive input end of the comparator CMP1 receives the reference voltage VBG, and a negative input end of the comparator CMP1 receives the output voltage VIP_PRE of the soft start circuit 201. The comparator CMP1 generates the clear signal RESET according to the comparison between the output voltage VIP_PRE and the reference voltage VBG. In this embodiment, when the reference voltage VBG is greater than the output voltage VIP_PRE, the comparator CMP1 generates the clear signal RESET having a logical value of 1. On the contrary, when the reference voltage VBG is less than the output voltage VIP_PRE, the comparator CMP1 generates the clear signal RESET having a logical value of 0.

The transistor MD1 is turned on or turned off according to the reset activating signal PD_out. When the transistor MD1 is turned on (the reset activating signal PD_out having a logical value of 1), at an output end of the soft start circuit 201, a discharge operation may be performed through the transistor MD1 to pull down the output voltage VIP_PRE and to reset the soft start circuit 201. At the same time, the comparator CMP1 may determine that the output voltage VIP_PRE is lower than the reference voltage VBG, and generate the clear signal RESET having a logical value of 1. In this way, the logical value of the reset activating signal PD_out is cleared to a logical value of 0, so that the transistor MD1 is turned off, which stops pulling down the output voltage VIP_PRE.

After the output voltage VIP_PRE of the soft start circuit 201 is pulled down to be lower than the reference voltage VBG, the soft start circuit 201 performs again the soft start operation. During the soft start operation, the output voltage VIP_PRE of the soft start circuit 201 is gradually pulled up to an operation power.

Incidentally, in this embodiment, the reference voltage VBG may be provided by a band gap voltage generator, and may as well be provided by any other form of voltage generator. The voltage value of the reference voltage VBG may be determined depending on how low the output voltage VIP_PRE is required to be pulled down in order to reactivate the operation of the soft start circuit 201. Besides, the comparator CMP1 may be a hysteresis comparator, which reduces the possibility of incorrect comparison results generated when the output voltage VIP_PRE is close to the reference voltage VBG.

Figure 3:
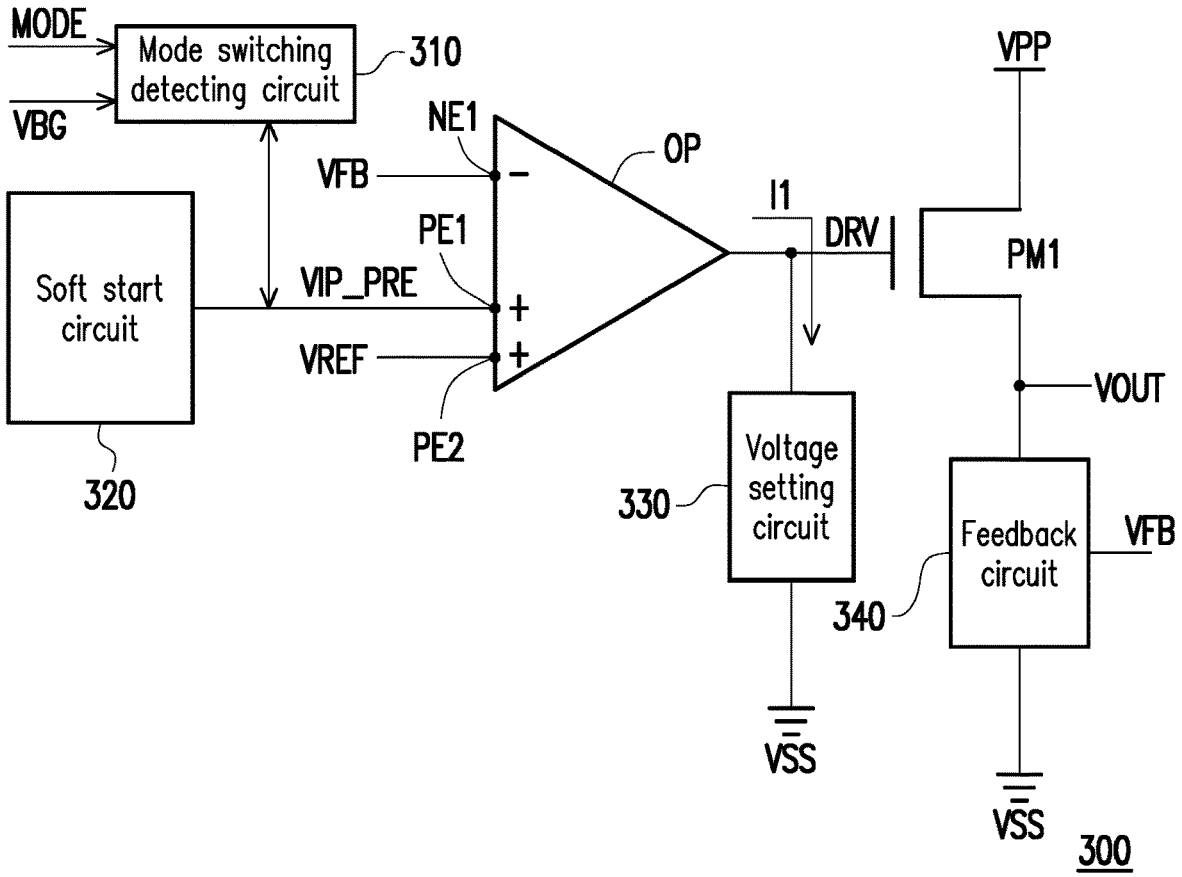
FIG. 3 is a schematic diagram showing a voltage regulating device according to an embodiment of the disclosure.

In the following, with reference to FIG. 3, which is a schematic diagram showing a voltage regulating device according to an embodiment of the disclosure, a voltage regulating device 300 includes a mode switching detecting circuit 310, a soft start circuit 320, an amplifier OP, a voltage setting circuit 330, a power transistor PM1, and a feedback circuit 340. The mode switching detecting circuit 310 receives the mode switching signal MODE and the reference voltage VBG. The mode switching detecting circuit 310 is coupled to an output end of the soft start circuit 320.

The amplifier OP has two positive input ends PE1 and PE2 to respectively receive the output voltage VIP_PRE of the soft start circuit 320 and a reference voltage VREF. Also, the amplifier OP has a negative input end NE1 to receive a feedback voltage VFB. An output end of the amplifier OP generates a driving voltage DRV. Besides, the voltage setting circuit 330 is coupled to the output end of the amplifier OP. A control end of the power transistor PM1 is coupled to the output end of the amplifier OP to receive the driving voltage DRV, a first end of the power transistor PM1 receives an operation power VPP, and a second end of the power transistor PM1 is coupled to the feedback circuit 340 and generates an output voltage VOUT. Also, the feedback circuit 340 is coupled to a reference ground end VSS to perform a voltage division on the output voltage VOUT to generate the feedback voltage VFB.

Specifically, during the operation, when a transition of the mode switching signal MODE occurs, the mode switching detecting circuit 310 is configured to provide a discharge path for a discharge operation to be performed at the output end of the soft start circuit 320, to pull down the output voltage VIP_PRE of the soft start circuit 320 to a sufficiently low voltage value and to reset the soft start circuit 320. In this way, the soft start circuit 320 may be reactivated, and a surge current generated in a voltage switching operation by the voltage regulating device 300 may be reduced. Herein, when the output voltage VOUT of the voltage regulating device 300 is switched between a first voltage and a second voltage, a transition of the mode switching signal MODE may occur. The first voltage and the second voltage may respectively be 3.3 volts and 1.8 volts. The first voltage and second voltage may also be of other voltage values, and is not particularly limited.

In this embodiment, the mode switching signal MODE may be input by an external electronic device and is configured to control the voltage regulating device 300 to perform the voltage switching operation.

The operation details of the mode switching detecting circuit 310 have been explained in detail in the foregoing embodiments, and will not be repeatedly described herein.

Notably, the voltage regulating device 300 according to the embodiment of the disclosure may work in a bypass mode. In the bypass mode, the voltage regulating device 300 may output the output voltage VOUT substantially equal to the operation power VPP. At this time, the voltage setting circuit 330 may pull down the voltage value of the driving voltage DRV according to a current Il provided by the output end of the amplifier OP. Since the power transistor PM1 is a P-type transistor, the on-resistance of the power transistor PM1 may be reduced according to the driving voltage DRV that is pulled down, so that the output voltage VOUT may be substantially equal to the operation power VPP.

Incidentally, in a normal mode other than the bypass mode, the voltage setting circuit 330 will not work. At this time, the voltage regulating device 300 may be a low dropout (LDO) voltage regulating device.

Figure 4:
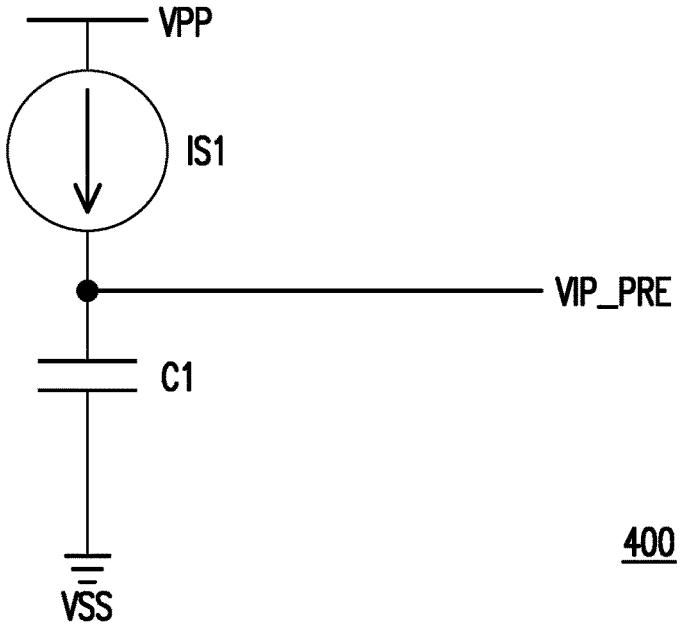
FIG. 4 is a schematic diagram showing a soft start circuit in a voltage regulating device according to an embodiment of the disclosure.

Next, with reference to FIG. 4, which is a schematic diagram showing a soft start circuit in a voltage regulating device according to an embodiment of the disclosure, a soft start circuit 400 includes a current source IS1 and a capacitor C1. The current source IS1 and the capacitor C1 are sequentially connected in series between the operation power VPP and the reference ground end VSS. The terminal where the current source IS1 and the capacitor C1 are coupled to each other is an output end of the soft start circuit 400, and is configured to generate the output voltage VIP_PRE. In this embodiment, in conjunction with the embodiment in FIG. 3, when the output voltage VOUT of the voltage regulating device 300 is stabilized at the first voltage, the output voltage VIP_PRE generated by the soft start circuit 400 may be equal to the operation power VPP. When the voltage switching operation of the voltage regulating device 300 is performed, a transition of the mode switching signal MODE occurs. At this time, the mode switching detecting circuit 310 may provide a discharge path to discharge the capacitor C1 according to the transition of the mode switching signal MODE. In this way, the output voltage VIP_PRE of the soft start circuit 400 may drop to be equal to or lower than a reference voltage VREF to reset the soft start circuit 400. Then, the mode switching detecting circuit 310 turns off the discharge path to reactivate the soft start circuit 400.

Through the soft start operation performed by the soft start circuit 400, the surge current that may be generated in the voltage switching operation performed by the voltage regulating device 300 can be effectively reduced. In this way, the voltage regulating device 300 and the system belonging thereto may be prevented from incorrect operation or even burning out resulting from the influence of the surge current, and effectively maintain the overall system performance.

Based on the foregoing, in the embodiments of the disclosure, the mode switching detecting circuit is disposed in the voltage regulating device so that the soft start circuit can be reset and reactivated in the voltage switching mode to reduce the surge current generated due to the voltage switching operation.

Finally, it should be noted that the foregoing embodiments are only used to explain, instead of limiting, the technical solutions of the disclosure. Although the disclosure has been described in detail with reference to the foregoing embodiments, people having ordinary skill in the art should understand that the technical solutions described in the foregoing embodiments may still be modified, or that some or all technical features therein may be equivalently replaced. However, the nature of the corresponding technical solutions so modified or replaced does not depart from the scope of the technical solutions of the embodiments of the disclosure.

What is claimed is:

1. A mode switching detecting circuit configured to reset a soft start circuit of a voltage regulating device, comprising:

a mode switching signal detector receiving a mode switching signal, and generating a setting signal according to a transition edge of the mode switching signal;

a reset signal generator coupled to the mode switching signal detector, and generating a reset activating signal according to the setting signal, wherein the reset activating signal drives the soft start circuit to perform a reset operation; and a reset status detector comparing an output voltage of the soft start circuit and a reference voltage to generate a clear signal, wherein the reset signal generator clears the reset activating signal according to the clear signal, wherein the mode switching signal detector delays the mode switching signal to generate a delay mode switching signal, and the mode switching signal detector compares the delay mode switching signal and the mode switching signal to generate the setting signal.

2. The mode switching detecting circuit according to claim 1, wherein the mode switching signal detector comprises:

a delay device configured to delay the mode switching signal to generate the delay mode switching signal; and an XOR gate receiving the delay mode switching signal and the mode switching signal, and generating the setting signal.

3. The mode switching detecting circuit according to claim 1, wherein the reset signal generator sets the reset activating signal to a first logical value according to the setting signal, and the reset signal generator comprises:

a D-type flip-flop having a data end that receives a first voltage of the first logical value, a clock end that receives the setting signal, and an output end that generates the reset activating signal.

4. The mode switching detecting circuit according to claim 3, wherein the reset status detector generates the clear signal when the output voltage of the soft start circuit is less than the reference voltage, a clear end of the D-type flip-flop receives the clear signal to set the reset activating signal to a second logical value, and the first logical value is opposite to the second logical value.

5. The mode switching detecting circuit according to claim 4, wherein the reset status detector comprises:

a comparator having a positive input end that receives the reference voltage, a negative input end that receives the output voltage of the soft start circuit, and an output end that generates the clear signal.

6. The mode switching detecting circuit according to claim 4, wherein the reset status detector further comprises:

a discharge switch coupled between an output end of the soft start circuit and a reference ground end, and performs a discharge operation at the output end of the soft start circuit according to the reset activating signal.

7. A voltage regulating device, comprising:

a soft start circuit;

an amplifier having a negative input end that receives a feedback signal, wherein the amplifier has a positive input end to be coupled to the output end of the soft start circuit, and the amplifier generates a driving voltage;

a power transistor receiving an operation power and, based on the operation power, generating a regulated output voltage according to the driving voltage; and the mode switching detecting circuit according to claim 1, coupled to an output end of the soft start circuit.

8. The voltage regulating device according to claim 7, wherein the soft start circuit comprises:

a current source providing a charging current based on the operation power in an activation time interval; and a capacitor coupled along with the current source to the output end of the soft start circuit, wherein the capacitor is configured to receive the charging current to generate an output voltage, wherein the soft start circuit enters the activation time interval according to the reset activating signal.

9. The voltage regulating device according to claim 7, further comprising:

a voltage setting circuit that sets the driving voltage according to a pull-up current provided by the amplifier in a bypass mode.

* * * * *